US005778472A

United States Patent [19]

Lang

[11] Patent Number: 5,778,472

[45] Date of Patent: Jul. 14, 1998

[54] CONTAINER LID CUTTER AND OPENER

[76] Inventor: Frank J. Lang, 28W 101 Main St., Warrenville, Ill. 60555

[21] Appl. No.: 882,100

[22] Filed: Jun. 25, 1997

[51] Int. Cl.[6] ..... B25F 1/00

[52] U.S. Cl. ..... 7/156; 7/151; 81/3.09; 81/3.55

[58] Field of Search ..... 7/151, 156, 105, 7/166; 30/1.5, 3.09, 3.55, 3.47; 81/3.57

[56] References Cited

U.S. PATENT DOCUMENTS

| | | | |
|---|---|---|---|
| 1,387,396 | 8/1921 | Herchen | 7/151 |
| 1,742,225 | 1/1930 | Sweeney | 81/3.09 |
| 2,261,729 | 11/1941 | Miller | 7/156 |
| 2,464,646 | 3/1949 | Mitchell | 81/3.09 |
| 3,117,374 | 1/1964 | Langner | 30/1.5 |
| 3,890,912 | 6/1975 | Young | 81/3.55 |
| 4,747,173 | 5/1988 | Marceau | 7/156 |

*Primary Examiner*—D. S. Meislin
*Assistant Examiner*—Joni B. Danganan
*Attorney, Agent, or Firm*—Breiner & Breiner

[57] ABSTRACT

A tool for removing lids from containers is formed from a single piece of planar rigid material by stamping or cutting therefrom a pattern and thereafter bending portions of the pattern into operative elements including a handle portion and a head portion. The head portion includes a first flange having a first flange flap, an inward projecting recess, a cutting flange having a cutting edge, a second flange, and a third flange, wherein the third flange and the cutting flange are bent to the same side of the tool to perform a cutting function while the first flange and the second flange are bent to the opposite side to facilitate a prying function.

6 Claims, 2 Drawing Sheets

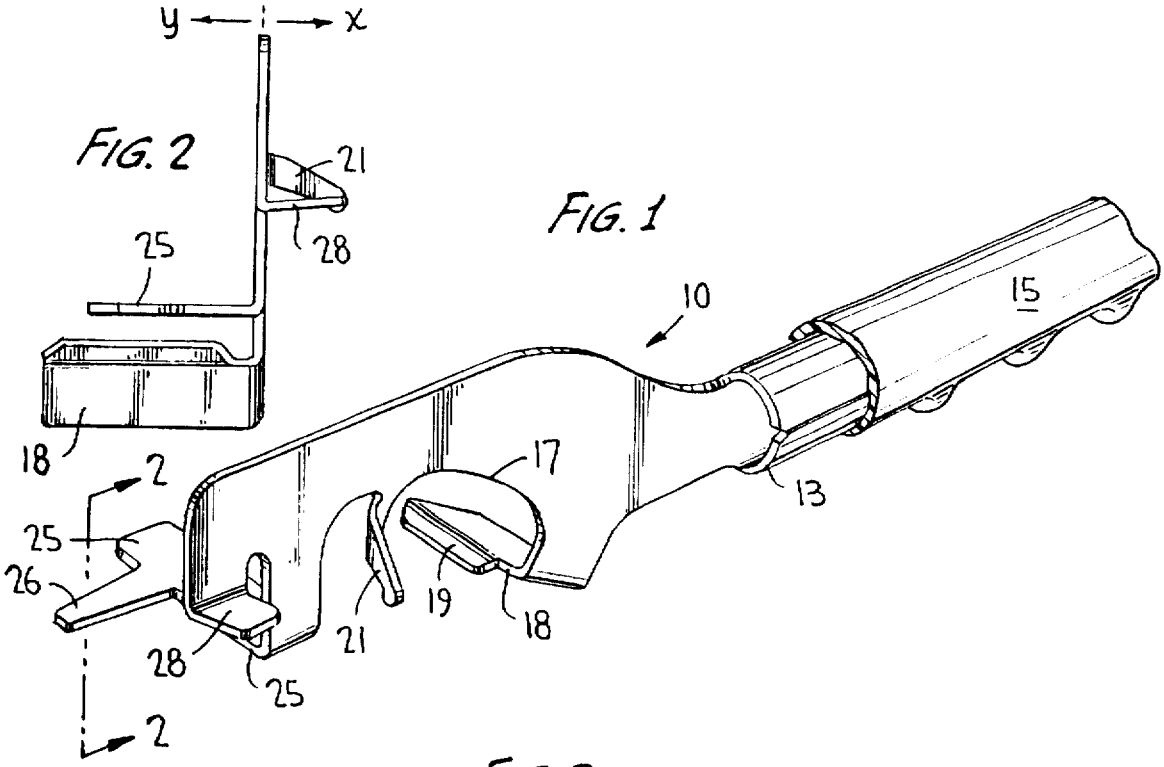
y
x
FIG. 2
21
28
25
18
FIG. 1
10
15
17
13
2
25
26
28
25
21
19
18
2
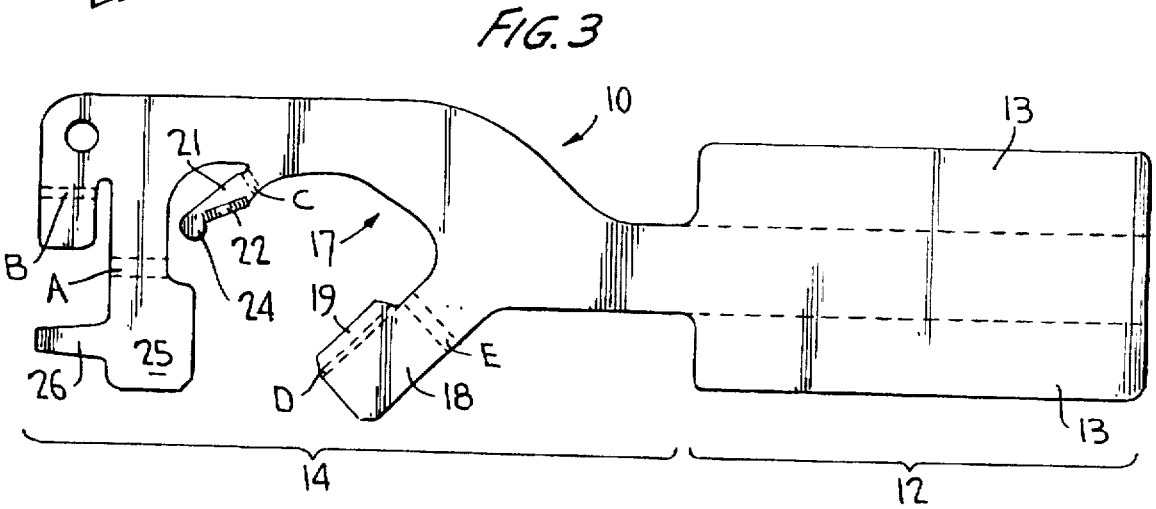
FIG. 3
10
13
21
C
22
17
B
A
24
19
E
25
26
D
18
13
14
12
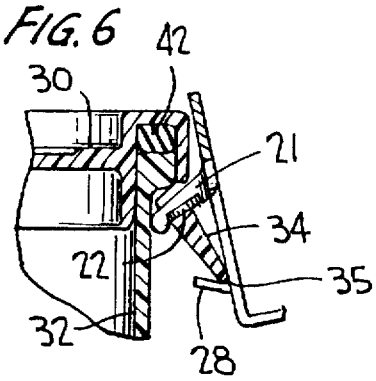
FIG. 6
42
30
21
34
22
35
32
28
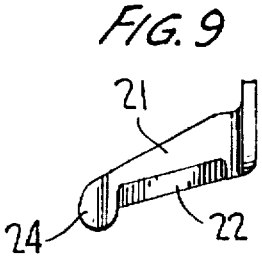
FIG. 9
21
24
22

FIG. 4
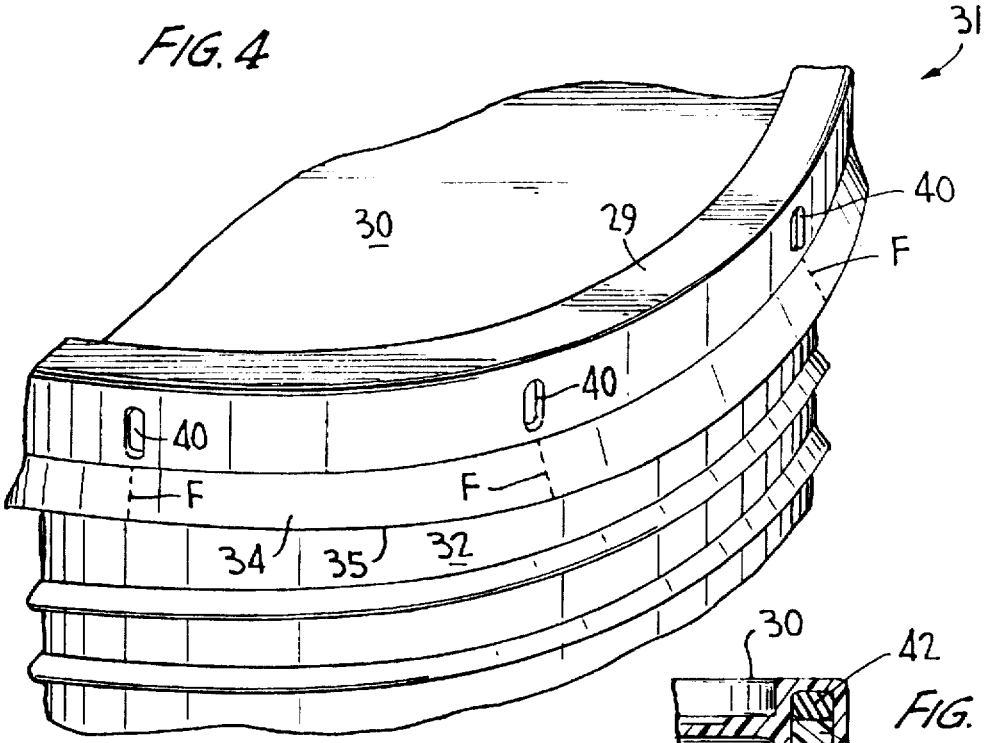
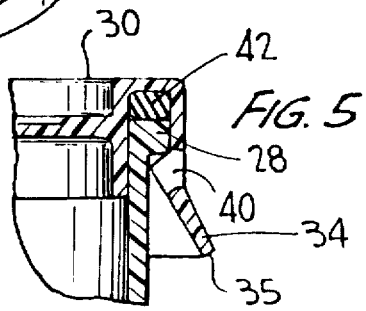
FIG. 5
FIG. 7
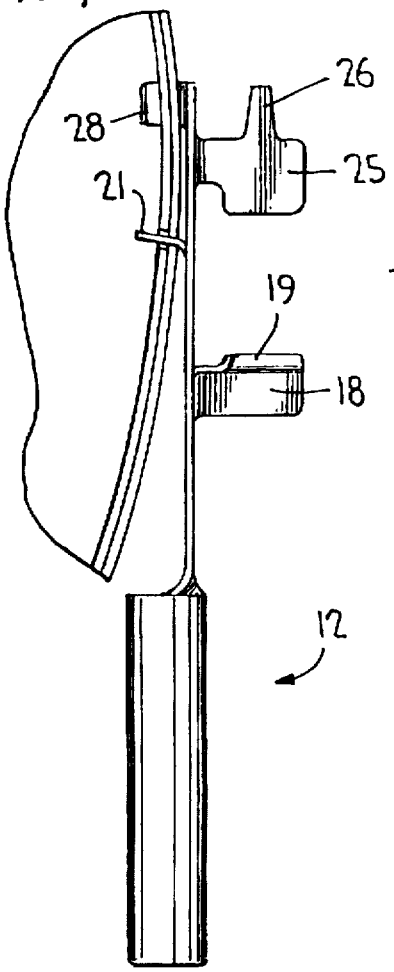
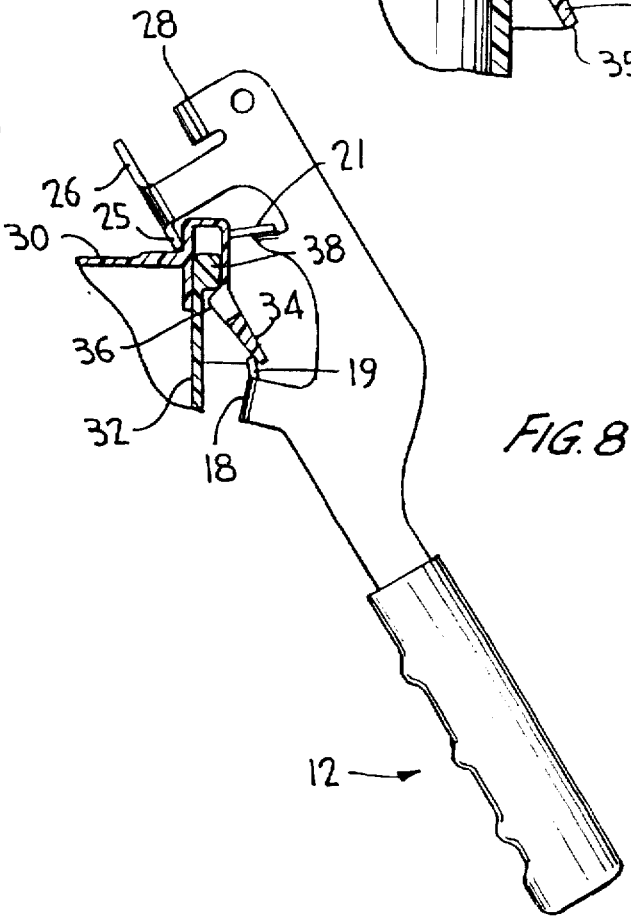
FIG. 8

CONTAINER LID CUTTER AND OPENER

FIELD OF THE INVENTION

The present invention is directed to a one piece cutter and opener generally used for removing covers or lids from large (generally 3 to 5 gallon) containers.

BACKGROUND OF THE INVENTION

Can openers, bucket openers, and pail openers of many types and varieties are known. However, many openers involve multiple parts or moving parts and many are dangerous to use or require special precautions in use. For example, many containers, such as 3 to 5 gallon buckets, are sealed with a lid that locks to the container and requires a series of slits or cuts in the lid in order to pry the lid from the container. These slits or cuts are often made by common retractable razor-knives or other sharp objects. Screw drivers are also commonly inserted into openings or windows formed in the lid's rim in order to forcibly deform the plastic lid until it breaks, thereby simulating the slit or cut. Often great force, sharp edges and implements, and/or unusual leverages are required that can result in the tipping or spilling of the contents of the container or personal injury to the person opening the container. Furthermore, when opening containers with known devices, removal of the lid often damages the ring seals and gasket devices thereby rendering the container incapable of being effectively resealed. U.S. Pat. Nos. 4,658,455 and 5,069,090 disclose tools used in opening containers. However, their use is limited primarily to prying functions. Known openers are generally replete with a number of shortcomings that are addressed only by the present invention.

BRIEF DESCRIPTION OF THE INVENTION

A tool for removing lids from containers is formed from a single piece of rigid planar material, preferably metal due to its strength and durability, by stamping a pattern and thereafter bending portions of the stamped pattern into operative elements. The operative elements include a handle portion and a head portion with the head portion including a first flange having a first flange flap, an inward projecting recess, a cutting flange having a cutting edge, a second flange, and a third flange. The third flange and the cutting flange are bent to the same side of the tool to provide a lever and fulcrum-type means of cutting a portion of a container lid. The first flange and the second flange are bent to the side of the tool opposite the third flange and the cutting flange and cooperate to pry a lid from a container in a can opener-type fashion.

A primary object of the present invention is to provide a cutter and opener formed from a single planar piece of material with portions thereof bent out of the plane to engage and remove a lid from a container without damaging ring seals or other gasketing used with the container and lid.

Another primary object of the invention is to provide a cutter and opener which functions when engaging tangentially the rim of a container as opposed to radial engagement.

Yet another primary object is to provide a single tool that can easily cut the rim of a locking container lid and thereafter pry the lid from the container with reduced risk of injury and/or spillage of container contents.

BRIEF DESCRIPTION OF THE DRAWINGS

A preferred embodiment of a container lid flange cutter and opener is described in greater detail hereinafter and is shown in the following attached drawings:

FIG. 1 is a perspective view of the tool of the present invention;

FIG. 2 is an end view of the invention taken along line 2—2 of FIG. 1;

FIG. 3 is a plan view of the pattern for the tool of the present invention after it is stamped or punched from a planar sheet of metal and before the operative portions thereof are bent at desired angles out of the plane of the metal sheet;

FIG. 4 is a perspective view of a lid attached to a container with which the tool of the present invention is useful in removing the lid;

FIG. 5 is a cut-away side view of the container and lid of FIG. 4;

FIG. 6 is a cut-away side view of the container and lid of FIG. 4 when engaged by the tool of the invention;

FIG. 7 is a cut-away top view of a lid of FIG. 4 when engaged tangentially by the invention;

FIG. 8 is a side view of a lid shown cut away with the tool of the present invention being engaged radially to lift the lid from the container; and FIG. 9 is a detailed view of the cutting flange of the invention.

DETAILED DESCRIPTION OF PRESENTLY PREFERRED EMBODIMENTS

Referring first to FIG. 3, the tool 10 is based on a pattern stamped or punched from a planar sheet of rigid material, preferably metal. Metal provides the necessary strength and is economic for manufacturing. In the description herein of the preferred embodiment, reference will be made to the tool being made from a metal planar sheet. The operative parts of the tool 10 are then formed by bending particular portions in a predetermined manner. When initially stamped from a planar sheet of metal, tool 10 has a head portion 14 and a handle portion 12.

The handle portion 12 has formable flaps 13 that are preferably bent or curved to form an easily gripable handle that is substantially cylindrical as shown in FIG. 1. Preferably a plastic coating or sheath 15 will be provided over the handle portion to allow for a better gripping surface.

The head portion 14 includes a first flange 18 with a first flange flap 19, a cutting flange 21 with a cutting edge 22 and a safety tip 24, a second flange 25 with an optional protrusion 26, a third flange 28, and an inward projecting recess 17 which is preferably a C-shaped recess. In forming the operative parts of the tool 10, first flange 18 is bent about 90 degrees, represented as being bent into the page in FIG. 3, along an axis E. The first flange flap 19 is bent slightly (from 5 to 90 degrees) out of the page along an axis D, preferably before first flange 18 is bent about axis E. The second flange 25 is bent about 90 degrees into the page at an axis A. The third flange 28 is bent at least 90 degrees out of the page at axis B, and preferably is bent at an angle greater than 90 degrees. The cutting flange 21 is bent at least 75 degrees out of the page at axis C.

FIG. 1 illustrates the tool 10 after each flange has been bent into its operative position. FIG. 2 is an end view of head portion 14. In using the tool, the third flange 28 and the cutting flange 21 cooperate to perform a cutting function on side X of the tool, as shown in FIG. 2, while the first flange 18 and the second flange 25 perform a separate prying function on side Y of the tool. Optional protrusion 26 may be used to open or pry standard paint can configured container lids or perform any similar screwdriver-type function.

FIG. 4 illustrates a container 31 having a lid 29 that is particularly suited for opening using the tool 10. The lid 29 has a drum portion 30, a shoulder-catch 36, and a lid rim 34 with an outermost edge 35. The container has a shoulder 38 that cooperates with the shoulder-catch 36 to keep the lid 29 connected to the container. The lid includes a plurality of openings 40 that are formed large enough to accept the cutting flange 21 of the tool 10. A sealing gasket 42 can be positioned between the lid 29 and the container shoulder 38 to provide a fluid seal between lid 29 and the container.

FIG. 5 illustrates a cut-away side view of the container and lid showing one opening of the plurality of openings 40.

FIG. 6 shows the tool 10 in one operative position wherein the cutting flange 21 has been inserted into one opening of the plurality of openings 40 such that the cutting edge 22 engages an edge of the lid rim 34 nearest the shoulder-catch 36. The third flange 28 is positioned under and catches the outermost edge 35 of the lid rim 34 such that the third flange 28 serves as a fulcrum, as illustrated in FIGS. 6 and 7. Downward pressure on the handle portion 12 causes the cutting edge to cut a path along line F through the lid rim 34 to thereby form a plurality of slits in the lid. Due to the position and the rounded or unsharpened edge of third flange 28, flange 28 acts as a safety feature to prevent accidental cutting of a user by cutting flange 21 once it clears the lid structure.

Once the slits have been formed, the tool can be used in a can opener-type fashion to pry the lid from the container, as illustrated in FIG. 8. The first flange flap 19 of the first flange 18 is inserted between the container wall 32 and the outermost edge 35 of the lid rim 34. The second flange 25 serves as a fulcrum to be placed on any upper surface of the lid, such as drum portion 30. Upward pressure on handle portion 12 causes first flange 18 to contact the lid rim 34 and rotate it such that the shoulder-catch 36 is displaced from locking cooperation with the shoulder 38. In this manner, each section of the lid rim 34 between adjacent openings of the plurality of openings 40 can be pried from the shoulder 38 sequentially around the circumference of the container until the lid 29 is easily removable.

The handle portion 12 is preferably sufficiently long such that a user's hand is not close enough to the container and lid to be pinched, cut, scraped, or otherwise injured during cutting, prying, or upon sudden unexpected disengagement of the tool from its operative position.

FIG. 9 shows the safety tip 24 on the cutting flange 21. The safety tip 24 facilitates safe and easy carrying, operation, and storing of the tool and reduces risk of injury often associated with known openers, such as retractable razor-type knives.

As will be apparent to one skilled in the art, various modifications can be made within the scope of the aforesaid description. Such modifications being within the ability of one skilled in the art form a part of the present invention and are embraced by the appended claims.

It is claimed:

1. A cutting and opening tool comprising:

operative elements comprising a handle portion and a head portion connected to the handle portion, wherein the head portion includes a main body defining a head plane having attached thereto a first flange having a first flange flap, an inward projecting recess, a cutting flange having a cutting edge, a second flange, and a third flange, wherein the first flange and the second flange are bent along an axis of each flange, respectively, about 90 degrees in a first direction out of said head plane, and wherein the third flange and the cutting flange are each bent out of said head plane in a second direction substantially opposite to the first direction, with said third flange being bent at least 90 degrees out of said head plane and said cutting flange being bent at least 75 degrees out of said head plane.

2. A tool according to claim 1 wherein the tool is formed from a singular planar piece of rigid material configured such that portions of said piece are adapted to be bent out of said plane to define the operative elements of the tool.

3. A tool according to claim 2 wherein the handle portion further comprises formable flaps adapted to be shaped into a substantially cylindrical handle.

4. A tool according to claim 2 wherein the rigid material is metal.

5. A tool according to claim 1 wherein said second flange includes a protrusion which serves as a prying member.

6. A tool according to claim 1 wherein the operative elements are located in sequence starting from the handle portion as the first flange, the inward projecting recess, the cutting flange having a cutting edge, the second flange, and the third flange.

* * * * *